US007588469B2

(12) United States Patent
Luzzi

(10) Patent No.: US 7,588,469 B2
(45) Date of Patent: Sep. 15, 2009

(54) SAFELY SEPARATING ELECTRICAL CONNECTING SYSTEM

(75) Inventor: Glenn J. Luzzi, Mt. Bethel, PA (US)

(73) Assignee: Richards Manufacturing Company, Irvington, NJ (US)

( * ) Notice: Subject to any disclaimer, the term of this patent is extended or adjusted under 35 U.S.C. 154(b) by 0 days.

(21) Appl. No.: 11/774,217

(22) Filed: Jul. 6, 2007

(65) Prior Publication Data

US 2008/0009164 A1 Jan. 10, 2008

Related U.S. Application Data

(60) Provisional application No. 60/819,177, filed on Jul. 7, 2006.

(51) Int. Cl.
*H01R 25/00* (2006.01)
*H01R 27/02* (2006.01)

(52) U.S. Cl. ..... 439/639; 439/181; 439/921

(58) Field of Classification Search ..... 439/639, 439/805, 183, 921

See application file for complete search history.

(56) References Cited

U.S. PATENT DOCUMENTS

| | | | | | |
|---|---|---|---|---|---|
| 3,957,332 | A * | 5/1976 | Lambert, III | ..... | 439/38 |
| 4,202,591 | A * | 5/1980 | Borgstrom | ..... | 439/185 |
| 4,354,721 | A * | 10/1982 | Luzzi | ..... | 439/475 |
| 4,799,895 | A * | 1/1989 | Borgstrom | ..... | 439/183 |
| 4,863,392 | A * | 9/1989 | Borgstrom et al. | ..... | 439/185 |
| 5,421,750 | A * | 6/1995 | Crotty | ..... | 439/801 |
| 6,520,795 | B1 * | 2/2003 | Jazowski | ..... | 439/475 |
| 2006/0286837 | A1 * | 12/2006 | Luzzi | ..... | 439/181 |

* cited by examiner

*Primary Examiner*—Hae Moon Hyeon
(74) *Attorney, Agent, or Firm*—Stroock & Stroock & Lavan LLP

(57) ABSTRACT

An apparatus for connecting two or more members is provided wherein the apparatus includes a first leg having an opening, a conductive portion and an insulated portion extending between the conductive portion and the opening. A connecting member can electrically connect to the conductive portion and engage a cable assembly and an apparatus received in alternate legs of the apparatus.

12 Claims, 1 Drawing Sheet

SAFELY SEPARATING ELECTRICAL CONNECTING SYSTEM

CROSS-REFERENCE TO RELATED APPLICATIONS

This application claims the benefit of U.S. Provisional Application Ser. No. 60/819,177 filed on Jul. 7, 2006 entitled "KNOWN POINT ELBOW", which is hereby incorporated in its entirety by reference.

TECHNICAL FIELD OF THE INVENTION

The present invention relates to a connector system that may be used for connecting two or more components. More particularly, the present invention relates to a separable connector system for providing a variety of configurations of electrical components and is ideally suited for use with electrical equipment.

BACKGROUND OF THE INVENTION

An example of a currently available connector system for use with 600 A components such as bushings and connecting plugs includes a conductor extending beyond the molded insulation by about 0.050 inches at 15 and 25 kV and about 0.062 inches at 35 kV. Such an extended section in the 600 A components prevents safe disconnection of the components while energized.

One of the drawbacks of the currently available systems can manifest if the components are separated while energized. Results of such a separation include a short circuit to ground if the conductive jacket of the mating component, such as the insulating cap or an elbow, accidentally contacts the extended conductor. Alternatively, a flashover to ground can occur along the molded interface from the extended conductor to ground. Additionally, a splicer can be electrically shocked if the splicer comes into contact with the extended conductor while it is energized.

In light of the prior art discussed herein, it is desirable to provide a simple, safe, easy to install, connector system.

SUMMARY OF THE INVENTION

The present invention relates to a connector system for connecting electrical components such as a lug/cable assembly to an apparatus such as a bushing. The present invention is preferably directed to a system that, under no load, can be safely separated using an insulated hot stick. For example, certain embodiments of the invention include a 600 A connector which can be used with a connecting plug, a connecting plug-elbow or similar components.

An embodiment of the invention provides a system having a conductor system that does not extend beyond the molded insulation. Rather, the conductor system preferably ends well short of the molded insulation and is not exposed. In accordance with one embodiment wherein the connecting system is a "male" product having a threaded stud, a tool can be inserted into a bore and used to thread a threaded nut to the mating component, by way of non-limiting example, a bushing or another connecting plug. Alternatively, an embodiment of the present invention can comprise a stud receiving cavity rather than a stud itself, for use with terminals having studs attached thereto.

Thus, the present invention provides a method and apparatus for connecting components that substantially eliminates certain risks associated with separating components while energized.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawing in which.

DETAILED DESCRIPTION OF A PREFERRED EMBODIMENT

A detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention. The following presents a detailed description of a preferred embodiment of the present invention.

Figure 1:
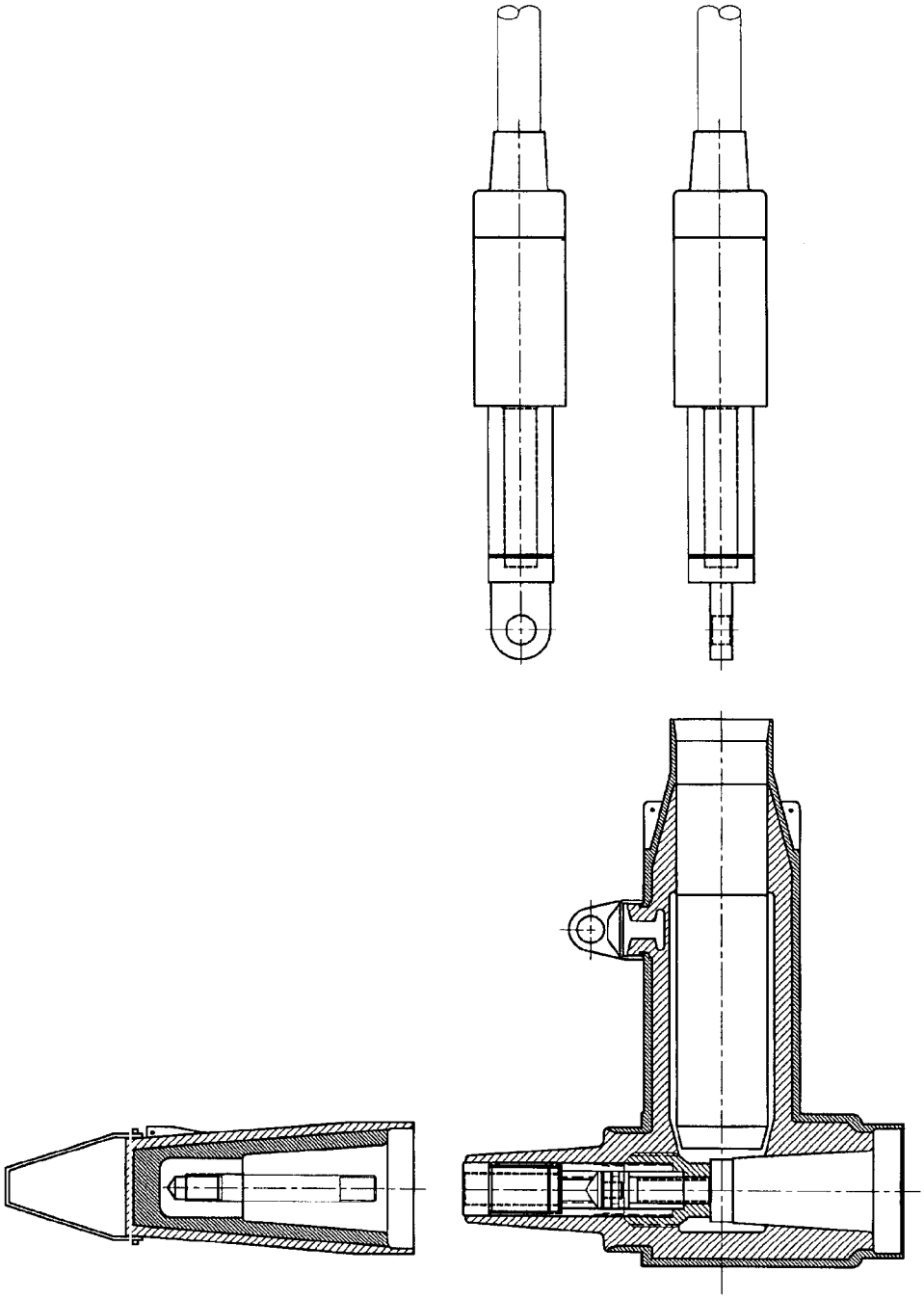
FIG. 1 is a cross sectional view of a connecting system in accordance with an embodiment of the present invention.
Figure 1:
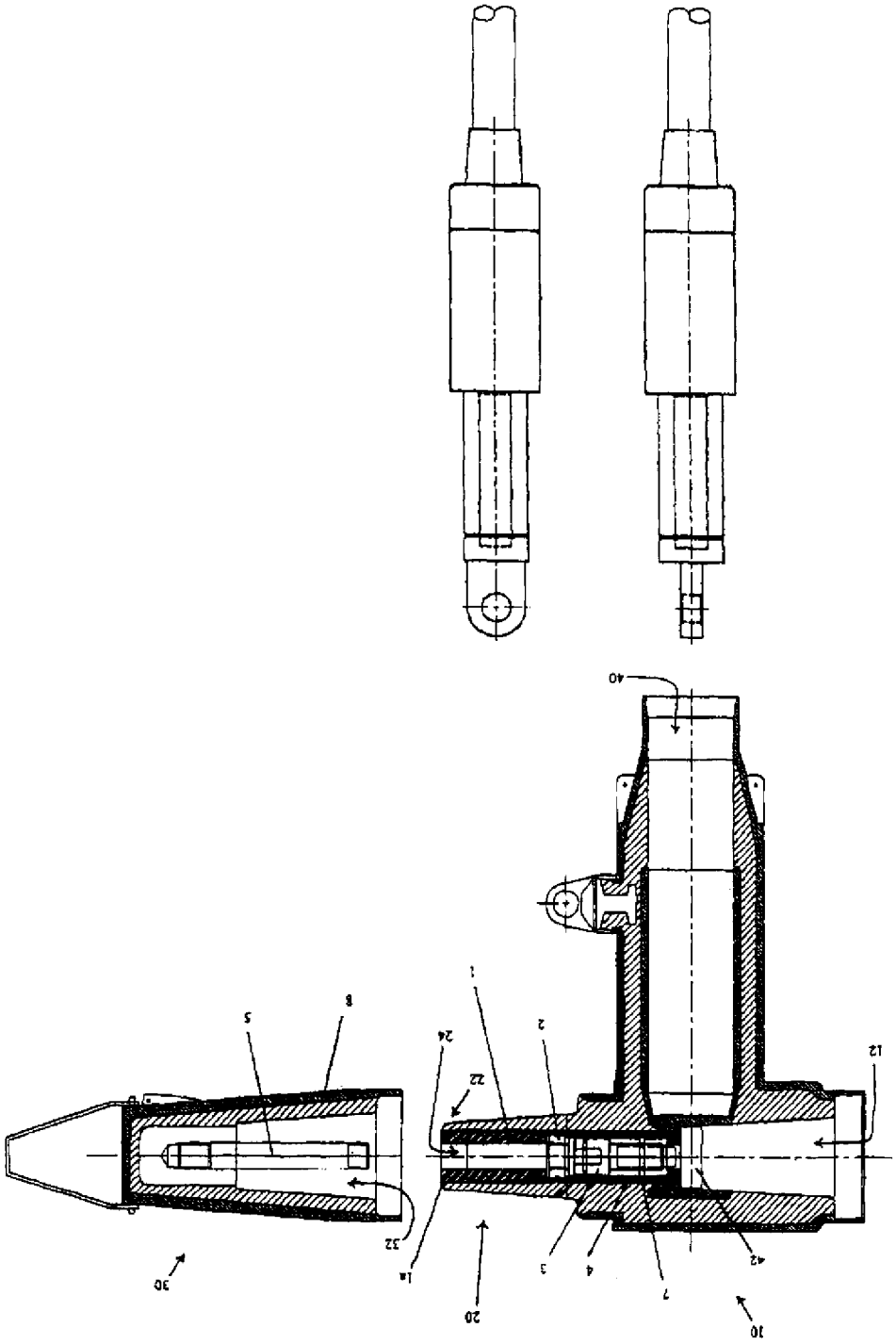

An embodiment of a connecting system is illustrated in FIG. 1, wherein an elbow 10 is provided having a first leg or component 20 having a component bore 24, an insulating portion 1, a housing 4 and a connecting member such as a bolt 3. Elbow 10 can also include a second leg having a first bore 12 and a third leg having a second bore 40. Component 20 is preferably capable of being connected with a mating part 30. Mating part 30 can include a mating bore 32 for receiving component 20 therein. In the embodiment shown, mating part 30 is shown as an insulating cap having a conductor system 5. However, it is to be understood that mating part 30 can vary in accordance with application specific design choice without deviating from the scope of the invention.

Whereas a variety of components 20 are contemplated, a 600 A component is shown. The embodiment of component 20 as illustrated includes a threaded bolt 3 which can preferably connect component 20 with an apparatus or mating component, for example a bushing or a connecting plug, received in first bore 12 of elbow 10. However, it is to be understood that component 20 can include a receiving cavity in lieu of threaded bolt 3 as a matter of application specific design choice.

Component 20 can further include a current carrying housing 4, for example a metal housing often referred to as a conductor or conductive portion, which is preferably electrically connected to and captivates bolt 3. In accordance with the embodiment illustrated, housing 4 does not extend the entire length of component 20. Rather, housing 4 ends substantially short of an outer end 22 of component 20. An insulated portion 1 preferably extends between housing 4 and outer end 22 of component 20. In the embodiment shown, insulated portion 1 is connected to, preferably fastened to housing 4.

Insulated portion 1 preferably includes an extended portion 1*a* which extends beyond outer end 22 of component 20. The length of extended portion 1*a* can be varied in accordance with the desired use. For example, the extended portion 1*a* can have a length of about 0.050 inches for use at about 15 kV and 25 kV. Alternatively, extended portion 1*a* can have a length of about 0.062 inches for use at 35 kV. Whereas in accordance with prior art systems, the conductor extends 0.050 inches or 0.062 inches from the end of the component, in accordance with certain embodiments of the invention, the insulated portion 1 extends 0.050 inches, 0.062 inches or another length from the end of the component.

Accordingly, in accordance with a preferred embodiment of the invention, if the mating part, such as insulating cap 30, is removed from the connecting system, the potentially electrically charged housing 4 is not exposed. Rather, because the insulated portion 1 extends past component 20, certain embodiments of the invention can provide increased safety compared to the prior art wherein the electrically charged conductor is often exposed. Because the potentially energized housing 4 is not exposed in certain embodiments of the invention, the risk of the splicer inadvertently contacting the energized housing 4 is substantially reduced. Likewise, the insulated portion 1*a* substantially prevents the conductive jacket 8 of mating part 30 from inadvertently contacting the energized housing 4. Moreover, housing 4 is preferably sufficiently far enough from the potentially grounded jacket of component 30 that it is unlikely for an arcing flashover to ground to occur at typical 15, 25 or 35 kV voltages.

Moreover, the energized housing is preferably positioned sufficiently within component 20, more specifically, sufficiently deep within component bore 24 which can preferably extend the flash-over distance of the exposed interface.

In accordance with a preferred embodiment of the invention, component 20 includes a retaining assembly, preferably including a retaining member. For example, in the embodiment illustrated in FIG. 1, component 20, preferably housing 4, can include a retaining member having a detent 2. Detent 2 can preferably insure that a connecting member such as the bolt 3 is maintained in the withdrawn position, wherein the bolt 3 is withdrawn away from a lug having a lug aperture (Reference Numbers not assigned), through which the bolt 13 can extend. It may be preferred to maintain the bolt 3 in the withdrawn position during shipping and assembly of the lug/cable assembly which can thereafter be inserted into second bore 40 of elbow 10. Preferably, the lug/cable assembly includes a lug having a lug aperture, the lug constructed and arranged to be at least partially received in lug cavity 42. The bolt 3 can preferably be extended through the lug aperture into first bore 12, and more preferably into the mating component received within first bore 12. Preferably, bolt 3 connects the lug/cable assembly to the mating component.

Component 20 can also include a second retaining member having a second detent 7 constructed and arranged to retain bolt 3 in a first extended position or in a second extended position in between the first extended position and the withdrawn position, such as a slippable position wherein the bolt can be loosened from the mating component and backed out into the housing 4 while limiting the movement of the bolt 3. For example, second detent 7 preferably limits the displacement of bolt 3 by preventing bolt 3 from withdrawing beyond the lug aperture of the lug/cable. Therefore, the assembly of the lug/cable assembly and the elbow 10 can be maintained while permitting the assembly to be removed from the mating component such as a bushing. The assembly can subsequently be connected to another bushing or other mating component.

Referring to the embodiment of mating part 30 illustrated, an insulating cap is shown having a conductor system 5 which preferably extends within component bore 24 until conductor system 5 contacts housing 4. For example, housing 4 can include a threaded section for engaging the conductor system 5. In the embodiment shown, detent 2 can include a threaded portion to engage the conductor system 5 of the mating part 30. Preferably, if component 20 is modified, mating part 30 is also modified accordingly to provide engagement between component 20 and mating part 30. For example, mating part 30 may be extended to ensure that the conductor system 5 of mating part 30 properly engages housing 4 of component 20.

The examples provided are merely exemplary, as a matter of application specific to design choice, and should not be construed to limit the scope of the invention in any way. Thus, while there have been shown and described and pointed out novel features of the present invention as applied to preferred embodiments thereof, it will be understood that various omissions and substitutions and changes in the form and details of the disclosed invention may be made by those skilled in the art without departing from the spirit of the invention. For example, the length of the extended portion, the construction and arrangement of detent 2 and second detent 7, the relationship between mating part 30 and component 20, etc. can be varied without deviating from the scope of the invention. It is the intention, therefore, to be limited only as indicated by the scope of the claims appended hereto.

It is also to be understood that the following claims are intended to cover all of the generic and specific features of the invention herein described and all statements of the scope of the invention which, as a matter of language, might be said to fall therebetween.

I claim:

1. An apparatus for connecting a cable to a bushing and a 600 amp mating part having a mating bore and a conductor system, said apparatus comprising:

a first leg constructed and arranged to be received by the mating part, the first leg having a first bore constructed and arranged to receive the conductor system of the mating part, the first bore having an opening;

a conductive portion within the first leg, the conductive portion having a threaded portion constructed and arranged to threadingly engage the conductor system;

an insulated portion within the first leg extending between the conductive portion and the opening; and a connecting member within the first leg displaceable between a withdrawn position and an extended position.

2. The apparatus of claim 1, further comprising a retaining member within the first leg for retaining the connecting member in the withdrawn position.

3. The apparatus of claim 1, further comprising a retaining member within the first leg for retaining the connecting member in the extended position.

4. The apparatus of claim 1, further comprising a retaining member within the first leg for retaining the connecting member at a second extended position wherein the connecting member is positioned between a first extended position and the withdrawn position.

5. The apparatus of claim 1, further comprising an insulating housing, wherein the bore is located within the insulating housing.

6. The apparatus of claim 1, further comprising a second bore opposite said first bore and constructed and arranged to receive an apparatus.

7. The apparatus of claim 6, further comprising a third bore at an angle to said first bore and constructed and arranged to receive a cable assembly.

8. The apparatus of claim 1, further comprising a second bore opposite said first bore and constructed and arranged to receive an apparatus and a third bore at an angle to said first bore and constructed and arranged to receive a cable assembly having a lug having a lug aperture; wherein the connecting member is constructed and arranged to be inserted into the lug aperture when in the extended position.

9. The apparatus of claim 1, wherein the first leg comprises a 600 amp connector.

10. The apparatus of claim 1, further comprising a connecting member within the first leg constructed and arranged to connect the apparatus to a mating component.

11. An apparatus for connecting a cable to a mating part having a conductor system, said apparatus comprising:

a first leg having components of a 600 amp connector constructed and arranged to connect the mating part, the first leg having a first bore constructed and arranged to receive the conductor system, the first bore having an opening and having a conductive portion and an insulated portion;

the conductive portion having a threaded portion constructed and arranged to threadingly engage the conductor system and a connecting member movable between a withdrawn position and an extended position; and the insulated portion extending between the conductive portion and the opening.

12. A 600 amp elbow for electrically connecting a cable assembly to a bushing and a mating part having a conductor system having a threaded portion, said elbow comprising:

a first bore having an opening to receive the cable assembly, the cable assembly having a lug having a lug aperture;

a second bore at substantially a right angle to the first bore, the second bore having an opening to receive the bushing;

a third bore, opposite the second bore, having an opening constructed and arranged to receive the conductor system of the mating part, the third bore having a conductive portion proximate the second bore and an insulated portion extending from the conductive portion to the opening;

the conductive portion of the third bore having a threaded portion to engage the threaded portion of the conductor system, and a connecting member within the conductive portion movable between a withdrawn position wherein said connecting member does not extend through the lug aperture and an extended position wherein said connecting member does extend through the lug aperture.

* * * * *

UNITED STATES PATENT AND TRADEMARK OFFICE

CERTIFICATE OF CORRECTION

PATENT NO. : 7,588,469 B2
APPLICATION NO. : 11/774217
DATED : September 15, 2009
INVENTOR(S) : Glenn J. Luzzi It is certified that error appears in the above-identified patent and that said Letters Patent is hereby corrected as shown below:

Delete the title page and substitute therefore the attached title page consisting of corrected illustrative figure.

Delete the Drawing Sheet and substitute therefore the attached Drawing Sheet showing corrected Figure 1.

Signed and Sealed this

Ninth Day of February, 2010

David J. Kappos

David J. Kappos
*Director of the United States Patent and Trademark Office*

(12) United States Patent
Luzzi

(10) Patent No.: US 7,588,469 B2
(45) Date of Patent: Sep. 15, 2009

(54) SAFELY SEPARATING ELECTRICAL CONNECTING SYSTEM

(75) Inventor: Glenn J. Luzzi, Mt. Bethel, PA (US)

(73) Assignee: Richards Manufacturing Company, Irvington, NJ (US)

( * ) Notice: Subject to any disclaimer, the term of this patent is extended or adjusted under 35 U.S.C. 154(b) by 0 days.

(21) Appl. No.: 11/774,217

(22) Filed: Jul. 6, 2007

(65) Prior Publication Data

US 2008/0009164 A1 Jan. 10, 2008

Related U.S. Application Data

(60) Provisional application No. 60/819,177, filed on Jul. 7, 2006.

(51) Int. Cl.
*H01R 25/00* (2006.01)
*H01R 27/02* (2006.01)

(52) U.S. Cl. ..... 439/639; 439/181; 439/921

(58) Field of Classification Search ..... 439/639, 439/805, 183, 921

See application file for complete search history.

(56) References Cited

U.S. PATENT DOCUMENTS

| | | | | | |
|---|---|---|---|---|---|
| 3,957,332 | A * | 5/1976 | Lambert, III | ..... | 439/38 |
| 4,202,591 | A * | 5/1980 | Borgstrom | ..... | 439/185 |
| 4,354,721 | A * | 10/1982 | Luzzi | ..... | 439/475 |
| 4,799,895 | A * | 1/1989 | Borgstrom | ..... | 439/183 |
| 4,863,392 | A * | 9/1989 | Borgstrom et al. | ..... | 439/185 |
| 5,421,750 | A * | 6/1995 | Crotty | ..... | 439/801 |
| 6,520,795 | B1 * | 2/2003 | Jazowski | ..... | 439/475 |
| 2006/0286837 | A1 * | 12/2006 | Luzzi | ..... | 439/181 |

* cited by examiner

*Primary Examiner*—Hae Moon Hyeon
(74) *Attorney, Agent, or Firm*—Stroock & Stroock & Lavan LLP

(57) ABSTRACT

An apparatus for connecting two or more members is provided wherein the apparatus includes a first leg having an opening, a conductive portion and an insulated portion extending between the conductive portion and the opening. A connecting member can electrically connect to the conductive portion and engage a cable assembly and an apparatus received in alternate legs of the apparatus.

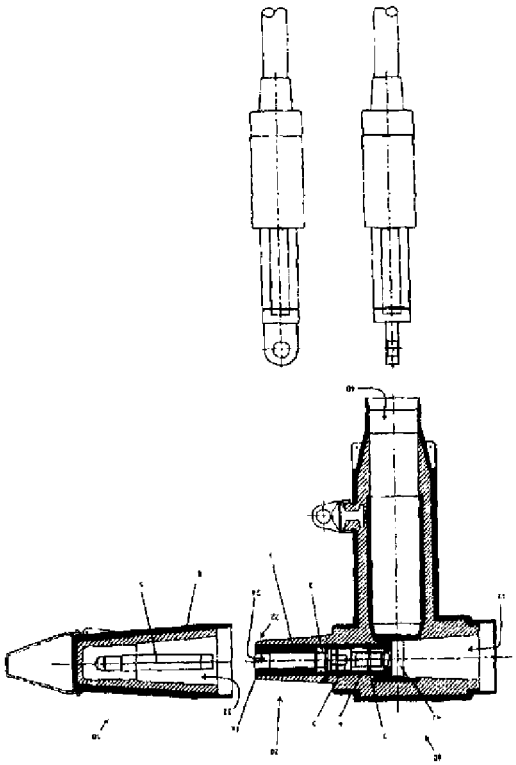

12 Claims, 1 Drawing Sheet